United States Patent [19]

Southard

[11] 4,449,612

[45] May 22, 1984

[54] TREE STEP

[76] Inventor: Benny S. Southard, Rte. 1, Box 177, Summerfield, N.C. 27358

[21] Appl. No.: 499,833

[22] Filed: Jun. 1, 1983

[51] Int. Cl.[3] ..... A63B 27/00; A63B 29/04

[52] U.S. Cl. ..... 182/92; 182/228; 108/152

[58] Field of Search ..... 182/92, 91, 90, 228; 248/216.1; 108/152

[56] References Cited

U.S. PATENT DOCUMENTS

| | | | |
|---|---|---|---|
| 3,298,459 | 1/1967 | Bergsten | 182/92 |
| 3,380,697 | 4/1968 | Melcher | 182/92 |
| 3,498,409 | 3/1970 | Meyer | 182/92 |
| 3,729,160 | 4/1973 | D'Imperio | 108/152 |
| 4,413,706 | 11/1983 | Michael | 248/216.1 |
| 4,415,061 | 11/1983 | Meyer | 182/92 |

*Primary Examiner*—R. P. Machado

[57] ABSTRACT

A tree step having an integral angle bracket with an obtuse angle forming a foot-supporting portion and a projecting tree-engaging leg with a projecting supporting arm connected pivotally and lockably to the angle bracket intermediate its ends with the free end of the projecting supporting arm having a tree-securing means thereon at the free end. The free end of the projecting tree-engaging leg of the angle bracket forms the hypotenuse of a right triangle when the tree step supporting arm is secured to a tree trunk with the tree trunk and the projecting tree-engaging leg forming the legs of a right triangle. The foot-supporting portion of the bracket projects outwardly from the supporting arm and upwardly from the tree-engaging leg.

6 Claims, 3 Drawing Figures

TREE STEP

BACKGROUND AND OBJECTIVES OF THE INVENTION

1. Field of the Invention

This invention relates generally to a tree step to be used by hunters and tree climbers. The tree step is a compact, sturdy member provided with a step securing member for penetrating a tree trunk that will support the downward load of a tree climber by transmitting forces downwardly and inwardly against a tree without subjecting the tree to substantial damage.

2. Background and Description of the Prior Art

Hunters utilize tree climbing harnesses and ropes to ascend or climb a tree to a suitable elevation for mounting a tree stand or seat for observing and hunting game below. Harnesses and ropes are cumbersome, heavy and costly. To eliminate these problems, relatively compact portable steps of various types have been developed for tree insertion enabling a hunter or tree climber to climb a tree using a number of tree inserted steps. Many of such steps are bulky, others are difficult to assemble, and still others are prone to damage the tree while still others are costly and insecure when mounted.

The prior art discloses various types of portable steps for hunters and tree climbers and the following prior art is representative only: U.S. Pat. Nos. 3,298,459; 3,80,697; 3,498,409; and 3,729,160.

It is, therefore, an objective of this invention to provide a compact and sturdy tree step that may be readily mounted in a tree with minimum effort and maximum load transmitting characteristics.

Another objective of the present invention is the provision of a tree step that is provided with a helical thread for tree insertion by using the tree step as a tool to facilitate insertion of the threaded end of a projecting supporting arm into the tree trunk.

Yet aother objective of the present invention is the provision of a durable, lightweight and foldable tree step that may be readily inserted and removed from a tree trunk without causing tree trunk damage and one in which the climbers load may be transmitted to the tree through the integral step which may be locked in position.

Other objectives and many attendant advantages of this novel tree step will become more readily apparent to those in the tree climbing and hunting art upon consideration of the drawing, detailed description and appended claims in which equivalents and modifications are contemplated.

SUMMARY OF THE INVENTION

This invention relates to a tree step comprising an integral angle bracket which may be in the form of a channel member having a U-shaped cross-section in which there is a foot-supporting portion integrally formed with a projecting tree-engaging leg portion. The projecting leg that engages a tree will transmit the load from the foot-supporting portion to the tree trunk and forms the hypotenuse of a substantial right triangle in which a projecting supporting arm is preferably pivotally connected to the angle bracket intermediate its ends and in which the angle bracket forms an obtuse angle with the projecting supporting arm being connected pivotally to the angle bracket adjacent to the apex of the obtuse angle. The free end of the projecting supporting arm is provided with a conical helical threaded portion for self threading into a tree trunk with the projecting supporting arm forming one side of a right triangle and the tree trunk forming the other side of the right triangle. The depending projecting leg of the angle bracket has a free end which engages the tree trunk in the tree step mounted position forming the hypotenuse of a right triangle with the projecting supporting arm and the tree trunk between the inserted supporting arm and the contact by the free end of the projecting leg of the angle bracket leaving the foot-supporting portion and extending portion of the projecting supporting arm exposed for receiving the foot of the tree climber. A locking cam end is provided at the opposite end of the projecting supporting arm from the threaded end to engage the base web of the U-shaped cross-section of the channel member in the open pivoted position which will prevent rotation of the foot-supporting portion under load conditions when mounted to a tree.

DESCRIPTION OF THE PREFERRED EMBODIMENT

Figure 2:
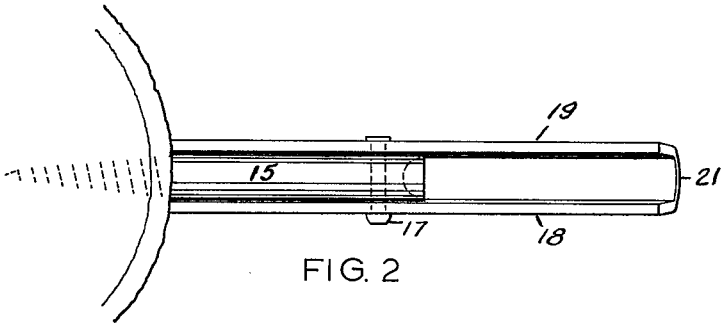
FIG. 2 is a top plan view of FIG. 1.
Figure 1:
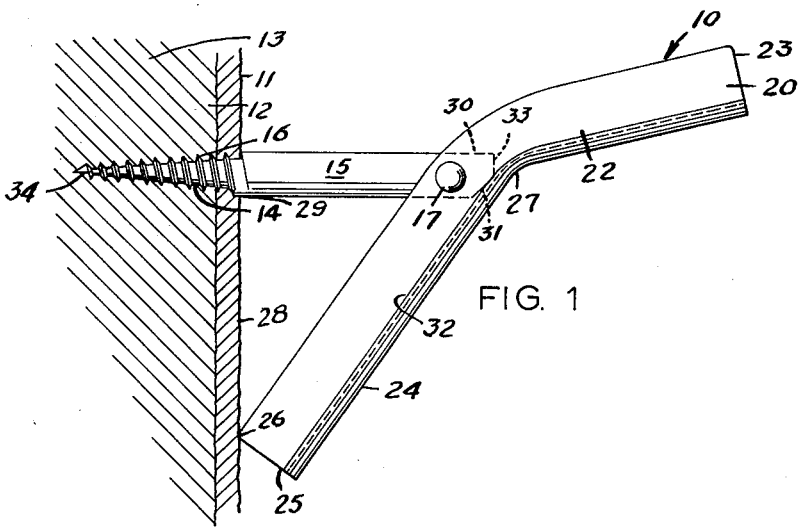
FIG. 1 is a side elevational view of a tree step mounted to a tree trunk in the operative open position.

Referring to the drawing and specifically to FIGS. 1 and 2, there is illustrated a tree step 10 that is securely fastened through the tree bark 11 to the core 12 of the tree trunk 13 through the conically-shaped free end 14 of the projecting supporting arm 15 on which conically-shaped free end helical threads 16 are formed for self-threading into the tree trunk core 12.

Figure 3:
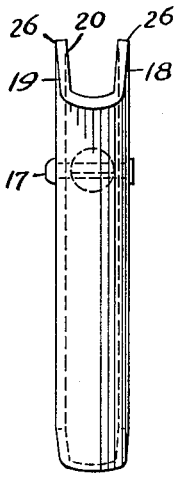
FIG. 3 is a right end view of FIG. 1.

The projecting supporting arm 15 is circular in cross-section and is pivotally connected by means of the pivot rivet 17 to the laterally spaced-apart walls 18 and 19 of the integral single bracket or channel member 20 which has a U-shaped cross section and a base web 21 that joins with the walls 18 and 19 as shown more clearly in FIG. 3. The integral U-shaped channel member 20 has a foot-supporting portion 22 having a free end 23 and a projecting tree-engaging leg portion 24 with its free end 25 extending downwardly permitting the corners 26 to "bite" into the tree bark 11 to limit displacement of the step and prevent step rotation when subjected to a load. The foot-supporting portion 22 and the projecting tree-engaging leg portion 24 form an obtuse angle 27 intermediate its ends and adjacent to the pivot rivet 17. In FIG. 1, the projecting tree-engaging leg portion 24 forms the hypotenuse of a right triangle in which the projecting supporting arm 15 forms one leg of the right triangle and the section 28 between the engagement of the ends 26 of the U-shaped channel member 20 and the bottom portion 29 of the projecting supporting arm 15 will form the other leg of the right triangle.

The inner end 30 of the supporting arm 15 has a free end beyond the pivot rivet 17 and is provided with a chamfer 31 for permitting pivoting of the supporting arm 15 clockwise in FIG. 1 into the channel member for nesting about the pivot rivet 17. The flat cam end 33 of the supporting arm will engage and lodge against the bottom of the base web 32 upon counterclockwise rotation of the U-shaped channel member in FIG. 1 which will permit the supporting arm 15 to be positioned perpendicular to the projecting tree-engaging leg 24 and will facilitate inserting and rotating the projecting leg 15 into the tree trunk by using the channel member with its foot-supporting portion 22 and tree-engaging portion 24 as a substantially T-shaped handle for rotating supporting arm 15 to thread the helical screw threads 16 through the bark 11 into the trunk core 12 as well as to remove the tree step upon disengagement by rotation in the opposite direction.

When not being used or during storage, the supporting arm 15 may be pivoted into the channel member 20 between the walls 18 and 19. Clockwise rotation of the U-shaped member is limited, in FIG. 1, to contacting the flat cam end 33 of the supporting arm 15 when the projecting tree-engaging leg portion 24 forms a right angle with the supporting arm 15.

The channel member 20 is preferably made of steel as is the supporting arm 15. For ease of insertion of the pointed end 34 through the tree bark 11 and trunk core 12, a small axe or hammer may be used in axial alignment to drive the threaded end 16 of the supporting arm 15 into the tree trunk partially before manual rotation of the T-shaped handle of the step member.

It is contemplated, of course, that a series of tree steps 10 will be used at different elevations and will facilitate climbing by being used both as hand grips as well as foot supporting members while ascending and descending a tree. After use, the tree step 10 may be removed readily from a tree and the supporting arm 15 pivoted into the channel member 20 for storage and future use in a compact manner.

I claim:

1. A tree step comprising; an integral angle bracket having a foot-supporting portion and a projecting leg portion, said projecting leg portion having a tree-engaging end portion, a projecting supporting arm having opposite ends, one of said ends being secured to said angle bracket intermediate its ends, and the other said end being free, said other free end having a tree-engaging securing means thereon for supporting said integral angle bracket whereby upon retaining the projecting supporting arm in a horizontal position in a tree, said foot-supporting portion is substantially horizontal and said projecting leg portion forms a hypotenuse of a right triangle upon tree engagement by said tree-engaging end portion of said supporting arm.

2. A tree step as claimed in claim 1, said tree-engaging securing means being pivotally secured to said bracket.

3. A tree step as claimed in claim 1, said integral angle bracket being a channel member having a U-shaped cross-section with a base web, said foot-supporting portion and said projecting leg portion forming an obtuse angle therebetween, said projecting supporting arm being pivotally secured in said channel member adjacent to the apex of said obtuse angle.

4. A tree step as claimed in claim 1, said tree-engaging securing means including a conically-tapered helical screw for penetration into a tree trunk.

5. A tree step as claimed in claim 3, said projecting supporting arm having a free end extending beyond said one secured end to engage said base web in a position for rotation of said supporting arm.

6. A tree step as claimed in claim 5, and said tree-engaging securing means including a conically-tapered helical screw for threading penetration into a tree trunk upon rotation of said channel member.

* * * * *